US010219554B2

(12) United States Patent
Farron et al.

(10) Patent No.: US 10,219,554 B2
(45) Date of Patent: Mar. 5, 2019

(54) FREEDOM OF MOVEMENT JACKET/COAT

(71) Applicant: Nike, Inc., Beaverton, OR (US)

(72) Inventors: Daniel Farron, Amsterdam (NL); Lindsey V. J. Martin, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 377 days.

(21) Appl. No.: 14/850,193

(22) Filed: Sep. 10, 2015

(65) Prior Publication Data

US 2015/0374050 A1 Dec. 31, 2015

Related U.S. Application Data

(63) Continuation-in-part of application No. 13/673,260, filed on Nov. 9, 2012, now Pat. No. 10,004,280.

(51) Int. Cl.
*A41D 1/00* (2018.01)
*A41D 3/00* (2006.01)
(Continued)

(52) U.S. Cl.
CPC ..... *A41D 3/00* (2013.01); *A41D 3/02* (2013.01); *A41D 13/0015* (2013.01); *A41D 15/007* (2013.01); *A41D 27/04* (2013.01); *A41D 27/10* (2013.01); *A41D 2200/00* (2013.01); *A41D 2400/20* (2013.01); *A41D 2600/10* (2013.01)

(58) Field of Classification Search
CPC ... A41D 1/02; A41D 1/04; A41D 3/02; A41D 3/04; A41D 15/00; A41D 31/02
USPC ..... 2/85, 86, 88, 89, 91, 92, 94, 96, 95, 93, 2/97, 102, 103, 106, 113, 114, 125, 309, 2/913
See application file for complete search history.

(56) References Cited

U.S. PATENT DOCUMENTS 1,190,504 A 7/1916 Bernstein
1,361,892 A 12/1920 Naterman
(Continued)

FOREIGN PATENT DOCUMENTS

CN 2232210 Y 8/1996
CN 101584501 A 11/2009
(Continued)

OTHER PUBLICATIONS

International Search Report with Written Opinion dated Apr. 14, 2014 in International Application No. PCT/US2013/069246, 8 pages.
(Continued)

*Primary Examiner* — Katharine Gracz
(74) *Attorney, Agent, or Firm* — Shook Hardy & Bacon LLP

(57) ABSTRACT

The present invention relates to a jacket/coat designed to provide an enhanced range of motion. This is accomplished by having a layered construction comprising different fabric/textile materials where the enhanced range of motion is desired. The jacket/coat in accordance with the present invention particularly provides an enhanced range of motion for a wearer around the shoulders and arms. This enhanced range of motion may be especially beneficial when the wearer is engaged in a physically demanding activity or any activity benefitting from a wide range of movement by the wearer's arms and shoulders.

20 Claims, 14 Drawing Sheets

(51) Int. Cl.

| | |
|---|---|
| ***A41D 3/02*** | (2006.01) |
| ***A41D 13/00*** | (2006.01) |
| *A41D 27/04* | (2006.01) |
| *A41D 27/10* | (2006.01) |
| *A41D 15/00* | (2006.01) |

(56) References Cited

U.S. PATENT DOCUMENTS

| | | | | |
|---|---|---|---|---|
| 2,159,408 | A | 5/1939 | Siegel | |
| 2,177,543 | A | 10/1939 | Vecchi | |
| RE21,676 | E | 12/1940 | Shane | |
| 2,270,435 | A | 1/1942 | Hansen | |
| 2,279,761 | A | 4/1942 | Schatten | |
| 2,330,520 | A | 9/1943 | Saveth | |
| 2,514,276 | A | 7/1950 | Berman | |
| 2,614,258 | A | 10/1952 | Breier | |
| 2,707,786 | A | 5/1955 | Stoner | |
| 3,049,719 | A | 8/1962 | Hyman | |
| 3,231,899 | A * | 2/1966 | Seidel | A41D 3/02 2/247 |
| 4,195,362 | A | 4/1980 | Rolando | |
| 4,320,538 | A | 3/1982 | Saft | |
| 4,608,715 | A | 9/1986 | Miller et al. | |
| 4,864,656 | A | 9/1989 | Nesse | |
| 4,937,884 | A | 7/1990 | Sherman | |
| 4,999,850 | A | 3/1991 | Grilliot et al. | |
| 5,687,423 | A * | 11/1997 | Ross | A41D 27/28 2/70 |
| 6,053,852 | A | 4/2000 | Wilkinson | |
| 6,895,597 | B1 | 5/2005 | Rakic | |
| 7,028,342 | B1 | 4/2006 | Nordstrom et al. | |
| 7,117,539 | B1 | 10/2006 | Baacke | |
| 7,343,629 | B2 | 3/2008 | Hunt | |
| 7,578,005 | B2 | 8/2009 | Vereen | |
| 7,636,948 | B1 | 12/2009 | Crye et al. | |
| 7,770,234 | B2 | 8/2010 | Roux et al. | |
| 7,966,668 | B2 | 6/2011 | Bay | |
| 8,209,773 | B2 | 7/2012 | Bothwell | |
| 2008/0005825 | A1 | 1/2008 | Tronvold | |
| 2008/0060113 | A1 | 3/2008 | Walsh | |
| 2009/0070914 | A1 | 3/2009 | Landeck et al. | |
| 2009/0247046 | A1 | 10/2009 | Fine | |
| 2010/0031415 | A1 | 2/2010 | Shadid | |
| 2010/0186136 | A1 | 7/2010 | Blauer et al. | |
| 2010/0199403 | A1 | 8/2010 | Greenblat | |
| 2010/0203803 | A1 | 8/2010 | Murphy et al. | |
| 2014/0130232 | A1 | 5/2014 | Farron et al. | |

FOREIGN PATENT DOCUMENTS

| | | | |
|---|---|---|---|
| CN | 202112343 | U | 1/2012 |
| CN | 202311338 | U | 7/2012 |
| CN | 102669843 | A | 9/2012 |
| CN | 202425666 | U | 9/2012 |
| GB | 2437699 | A | 7/2007 |
| JP | S4217929 | Y1 | 10/1967 |
| JP | S6296202 | A | 5/1987 |
| JP | H09170106 | A | 6/1997 |
| JP | 2002339120 | A | 11/2002 |
| JP | 3167570 | U | 4/2011 |

OTHER PUBLICATIONS

International Preliminary Report on Patentability dated May 21, 2015 in International Application No. PCT/US2013/069246, 7 pages.

Non-Final Office Action dated Oct. 20, 2014 in U.S. Appl. No. 13/673,260, 13 pages.

Final Office Action dated Jul. 8, 2015 in U.S. Appl. No. 13/673,260, 11 pages.

Non-Final Office Action dated Nov. 27, 2015 in U.S. Appl. No. 13/673,260, 12 pages.

Final Office Action dated Apr. 21, 2016 in U.S. Appl. No. 13/673,260, 13 pages.

European Search Report dated Jun. 1, 2016 in European Patent Application No. 13853319.5, 6 pages.

Non-Final Office Action dated Aug. 18, 1206 in U.S. Appl. No. 13/673,260, 13 pages.

European Search Report dated Sep. 29, 2016 in European Patent Application No. 13853319.5, 9 pages.

International Search Report with Written Opinion dated Nov. 29, 2016 in International Application No. PCT/US2016/050991, 8 pages.

Non-Final Office Action dated May 12, 2017 in U.S. Appl. No. 13/673,260, 13 pages.

European Office Action dated Jul. 12, 2017 in European Patent Application No. 13853319.5, 4 pages.

Final Office Action dated Jan. 26, 2017 in U.S. Appl. No. 13/673,260, 13 pages.

International Search Report and Written Opinion dated Jan. 2, 2018 in International Patent Application No. PCT/US2017/057602, 15 pages.

Final Office Action dated Nov. 14, 2017 in U.S. Appl. No. 13/673,260, 15 pages.

International Preliminary Report on Patentability dated Mar. 22, 2018 in International Application No. PCT/US2016/050991, 8 pages.

Notice of Allowance dated Mar. 26, 2018 in U.S. Appl. No. 13/673,260, 7 pages.

Non-Final Office Action dated Oct. 12, 2018 in U.S. Appl. No. 15/299,200, 17 pages.

* cited by examiner

FREEDOM OF MOVEMENT JACKET/COAT

CROSS-REFERENCE TO RELATED APPLICATIONS

This is a Continuation-in-Part Application of U.S. patent application Ser. No. 13/673,260, entitled "Freedom Of Movement Jacket/Coat," filed on Nov. 9, 2012. The entirety of the aforementioned application is incorporated by reference herein.

STATEMENT REGARDING FEDERALLY SPONSORED RESEARCH OR DEVELOPMENT

Not applicable.

TECHNICAL FIELD

The present invention relates to jackets and/or coats with enhanced range of motion. The present invention offers several practical applications in the technical arts, not limited to athletic wear, casual wear, etc. More particularly, the present invention relates to outer wear apparel that affords freedom of movement around the shoulders and arms of a wearer, especially when engaged in a physically demanding activity or any activity benefitting from a wide range of movement by the wearer's arms and shoulders.

BACKGROUND OF THE INVENTION

Weather often requires a person wear extra layers of clothing when outdoors. The extra layers of clothing may be constrictive, especially when engaging in an athletic activity, or any other type of physical activity. For example, golf is a sport that requires considerable range of motion in order to properly swing a club, but precipitation or cold weather may require extra clothing that can reduce the range of motion needed. A jacket/coat is a popular layering garment because it is versatile and usually has a loose fit, has a closable opening so it can be easily worn or taken off, and is usually made of a material that provides protection from environmental elements such as rain, wind, snow, temperature fluctuations, etc. The downside of using materials such as leather, or synthetic fabrics treated with materials to make them water repellent and/or wind repellent, may be that these materials may not have enough stretchability and/or breathability, or if they do have stretchability and/or breathability, the stretchability and/or breathability may be minimal. Such limited stretchability may render a garment impractical for activities requiring a higher degree of flexibility than is compatible with the garment. Further, for a sport such as golf, the potential fabrics to use for such a jacket may be limited by considerations such as the desire to limit the noise made by a garment during movement.

BRIEF SUMMARY OF THE INVENTION

An object of the present invention is to provide a comfortable jacket/coat that is protective from environmental elements such as rain, wind, etc. The jacket/coat in accordance with the present invention may have a layered construction, where different types of fabrics and or materials may be used in the different layers of the jacket/coat to achieve a comfortable wear for the wearer, without sacrificing the level of protection offered by the jacket/coat.

In a first example, the jacket/coat may comprise a first partial shrug-like portion (without the front pieces covering the chest) with a core, and with sleeves attached to the core. The sleeves may be long sleeves, short sleeves, three-quarter sleeves, or any other length desired for the particular style and use for the jacket. The first partial shrug-like portion may be constructed from an elastic and/or partially elastic type of material. The partial shrug-like portion and the sleeves may be made from a continuous piece of material, or the sleeved may be sewn onto the partial shrug-like portion at a given position below the shoulders to avoid having shoulder seams that may cause strain.

The partial shrug-like portion may optionally have a strain-relieving cutout on its back portion. The cutout may be triangular, for example, and may optionally have an elastic stabilizer to stabilize the cutout. For example, the cutout may be downwards pointing triangular shape with a stabilizing elastic band across the wide end of the triangle closer to the collar of the jacket/coat.

Further, the jacket/coat may comprise a vest portion that is longer than the partial shrug-like portion, layered on top of the partial shrug-like portion. The partial shrug-like portion may then be attached to the vest portion at a seam located at the bottom edge of the shrug-like portion, at the collar seam of the partial shrug-like portion and the vest portion, and at a front edge of each armhole to the corresponding front area of each respective sleeve, in other words, there may be no seams attaching the partial shrug-like portion and the vest portion on the back side of the jacket so that the sleeves may essentially be free-floating so that when a wearer may need to stretch his/her back pulling his/her arms forward or in any other direction, this motion may be performed freely.

The vest portion may be constructed from the same material as the partial shrug-like portion, or alternatively, may be constructed from a different material, which may be elastic and/or stretchable. A stretchable material may be a four-way stretchable textile, a two-way stretchable textile, a composite material, a sheet-type material, etc. Both the partial shrug-like portion and the vest portion may water-resistant or waterproof either inherently or due to a waterproofing treatment. Alternatively, an elastic and waterproof layer of a polymer material may be applied to the inner face of the material prior to making the jacket/coat, if waterproofing is desired.

Conceivably, in the case of rain or other environmental precipitation, or other water source, water could potentially enter through the gap on the back created where the sleeves are free-floating, and may accumulate in between the partial shrug-like portion and the vest portion. Therefore, the jacket/coat in accordance with the present invention may be provided with a plurality of perforations on the vest portion, slightly above the bottom edge seam between the partial shrug-like portion and the vest portion to allow the water to drain out without actually accumulating. Further, the bottom-edge of the partial shrug-like portion forming the seam, instead of being completely horizontal, may be slightly angled to guide any water present towards the plurality of perforations more efficiently in the water draining process. Depending on where the plurality of perforations is to be placed, the seam angle may be adjusted accordingly, for aesthetic and/or functional reasons. For example, if the perforations are in the middle of the back of the jacket/coat, the seam may form a slight semi-circular, or slight flat "V" shape angled just enough to guide the water toward the center, where gravity may work to pull the water down and be drained out of the jacket. The "V" shape may be maintained with a strap, a mesh insert, rigid or semi-rigid edges, etc., if such a structure is used.

In a different example of the jacket/coat in accordance with the present invention, the jacket/coat may comprise a shrug-like portion made out of a strong and flexible mesh-type material, or any other desired breathable material. The material forming the shrug-like portion may be made from synthetic and/or natural fibers, and additionally, may contain elastic fibers to add elasticity to the material. The sleeves of the jacket/coat may be attached to the shrug-like portion at the armholes of the shrug-like portion. The sleeves may be of any length desired for the jacket/coat, such as short, three-quarter, long, etc., and may be pieced together from different types of materials with differing properties such as elasticity, resiliency, etc.

The jacket/coat may further comprise a stiffer and longer vest portion over the shrug-like portion. The shrug-like portion may be free-floating inside the vest portion except for the seams at the collar, the bottom edge, and the front edges of the shrug-like portion. Since in this jacket/coat construction, the sleeves are free-floating from the stiffer vest portion at the shoulders, this construction may provide ventilation as well as enhanced range of motion, particularly when a wearer pulls his/her arms forward, or when a wearer lifts his/her arms above the shoulders.

In an additional example in accordance with the present invention, a garment formed from a shrug component and a partial vest component may be provided. In accordance with the present example, the shrug component may comprise at least one front panel, at least one back panel, a right sleeve, and a left sleeve. The vest component may comprise at least one front panel and at least one back panel, wherein the front and back panels may be affixed or attached to each other at left and right side seams, to form in part a right sleeve opening or armhole and a left sleeve opening or armhole. In the alternative, the at least one front panel and the at least one back panel may be formed from a single piece of material. As used throughout this disclosure, the terms affixed or attached mean permanently joined to one another using affixing technologies known in the art such as stitching, bonding, welding, and the like. Continuing, the shoulder seams of the vest component may not be attached to each other but rather, they may be attached/seamed to front and back shoulder portions of the right sleeve and left sleeve of the shrug component when the vest component and the shrug component are assembled together to form the garment. Further attachment points between the shrug component and the vest component may include the garment collar, a bottom edge of the shrug component, and in the case that the garment is a front opening jacket, at front edges of the garment where a releasable closing mechanism for the jacket may be provided. However, the shrug component and the vest component may not be attached to each other at portions where the right sleeve and the left sleeve of the shrug component meet the armhole edges of the vest component.

Yet, in a different example of the jacket/coat in accordance with the present invention, a thick winter jacket/coat may be provided. Since winter jackets tend to be bulky for insulating purposes, inevitably, they may have limited breathability and may be restrictive and not allow a user full range of motion. Therefore, in the jacket/coat in accordance with the present invention, a composite sleeve may be provided, which may provide breathability and/or enhanced range of motion without compromising insulation from cold weather. In other words, the sleeve may comprise three different sections: a lower sleeve, an upper sleeve and a cover sleeve. The lower sleeve may be constructed in the same way and with the same materials as the rest of the jacket/coat including the insulating fibers, and may cover an arm anywhere from the wrist up to the elbow. Then, the upper sleeve comprising a flexible and resilient mesh-type, or any other breathable type of material, may be attached to the lower sleeve by a seam, and may cover the arm up to the shoulder and be attached to the jacket/coat at the seam around the armhole. Finally, the cover sleeve may also be constructed from the same materials as the rest of the jacket/coat, including the insulating fibers, and may be attached to the jacket/coat by a seam connecting it to the armhole of the jacket, just as the upper sleeve. The cover sleeve may extend from the shoulder to slightly below the upper sleeve in order to completely conceal the upper sleeve when the arms of a wearer are in a rest position parallel to the wearer's body. It may be noted that the length ratios of the upper and lower sleeves may be other than the one described above, and the length of the cover sleeve may also change accordingly.

The jacket/coat with the composite sleeve in accordance with the present invention, may allow for improved airflow between the inside and outside of the jacket/coat and may provide enhanced flexibility for a user due to the flexibility provided by the upper sleeve material, keeping the wearer more comfortable. In other words, the composite sleeve construction in accordance with the present invention may provide enhanced temperature regulation, as well as an enhanced range of motion for the user, by stretching (lengthening) the sleeve as required by the motions performed by the wearer.

Additional objects, advantages, and novel features of the invention will be set forth in part in the description which follows, and in part will become apparent to those skilled in the art upon examination of the following, or may be learned by practice of the invention.

BRIEF DESCRIPTION OF THE DRAWINGS

The present invention is described in detail below with reference to the attached drawing figures, wherein.

DETAILED DESCRIPTION OF THE INVENTION

The present invention provides a jacket/coat with enhanced range of motion around the shoulders and the arms. In addition to enhanced range of motion, an additional advantage of the jacket/coat in accordance with the present invention is that it provides ventilation without compromising protection from the environmental elements.

Figure 1:
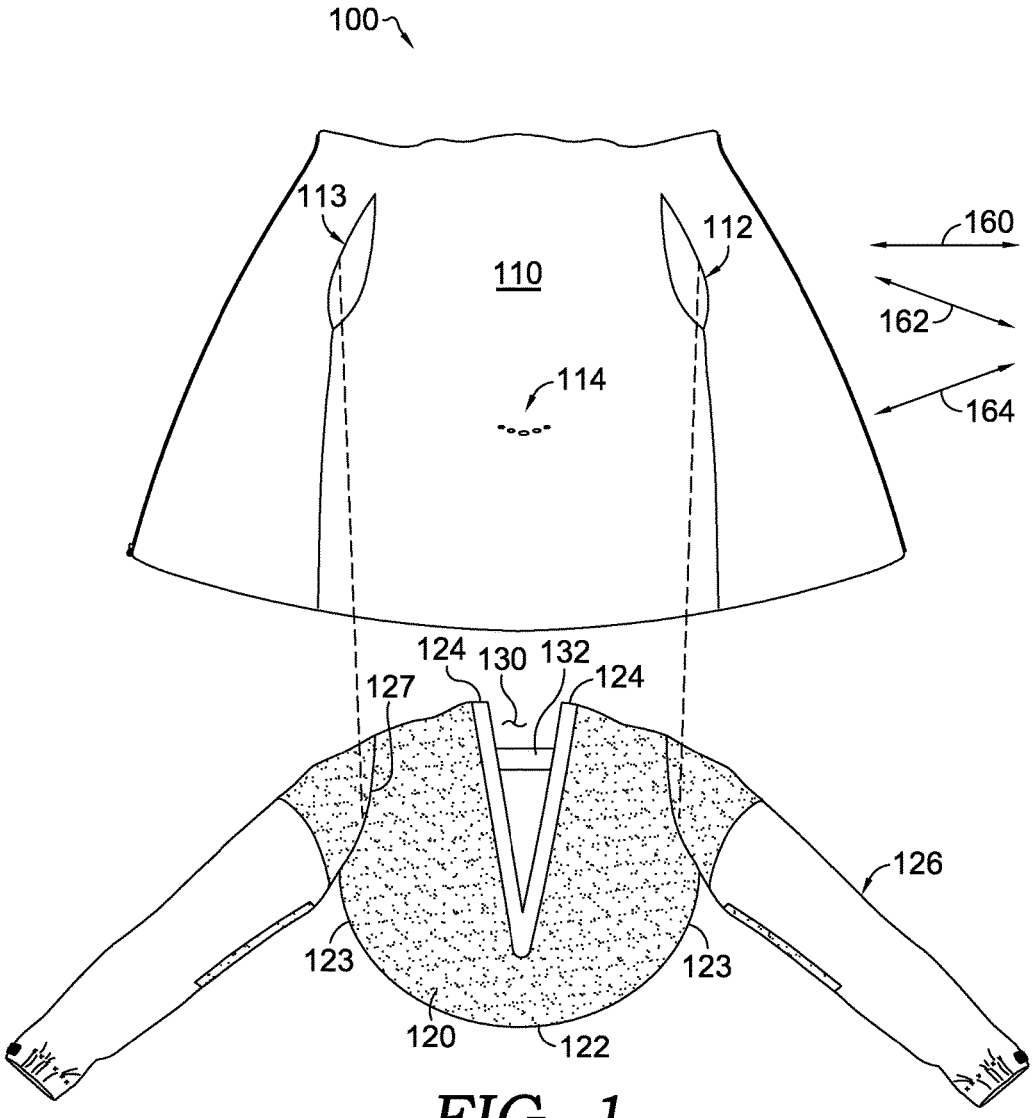
FIG. 1 is a deconstructed view of an exemplary jacket/coat in accordance with the present invention.

Referring to FIG. 1, a deconstructed jacket/coat 100 in accordance with the present invention is shown. As shown in FIG. 1, the jacket/coat 100 comprises two main components, a partial shrug-like portion (only covering the back) 120 comprising the sleeves 126, and a vest portion 110 comprising the full length of the jacket/coat 100.

Figure 14:
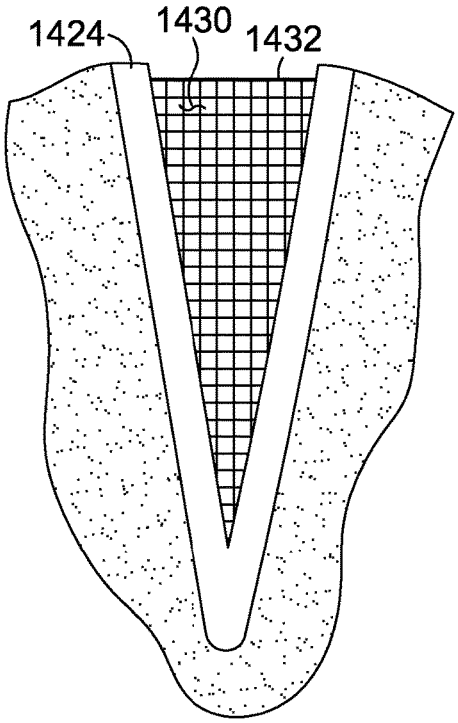
FIGS. 14 and 15 illustrate examples of alternative strain-relieving cutouts for jackets/coats in accordance with the present invention.
Figure 15:
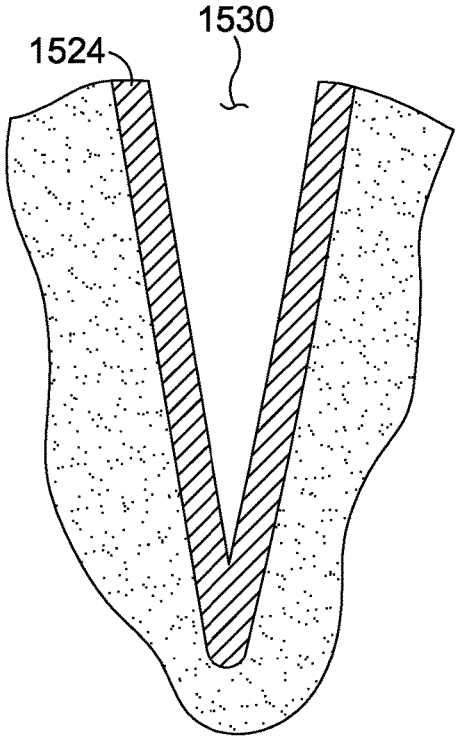

The partial shrug-like portion 120 may comprise a more elastic material than the vest portion 110. Further, the partial shrug-like portion 120 may comprise a strain-relieving cutout 130 extending, for example approximately 0.5 to 5 inches above the lower rounded edge 122 of the partial shrug-like portion 120, up to and including the collar edge 124 of the partial shrug-like portion 120. The strain-relieving cutout 130, may be stabilized by an elastic stabilizer 132 located approximately 0.5 to 5 inches below the cutout collar edge 124, where the collar seam would have been. The strain-relieving cutout 130 may be shaped like a "V" as shown, or any other shape suitable for its intended purpose. Elastic stabilizer 132 may be omitted or replaced, for example with a mesh. Examples of some alternative strain-relieving cutouts are depicted in FIGS. 14 and 15. FIG. 14 shows a V-shaped strain-relieving cutout 1430 with an edge 1424 stabilized with a mesh insert 1432, which may be stretchable. FIG. 15 shows a V-shaped strain-relieving cutout 1530 with a reinforced edge 1524 that maintains its form during use. Reinforced edge 1524 may be formed using layering, laminates, plastic inserts, metal inserts, seam tape, elastomers, etc. While the examples of strain-relieving cutouts suitable for use in a jacket/coat in accordance with the present invention have been illustrated with a V-shape, other shapes, such as a U-shape, may be used.

The sleeves 126 of the jacket/coat in accordance with the present invention may optionally be an integral and continuous part of the partial shrug-like portion 120. The sleeves 126 may comprise the same elastic material as the partial shrug-like portion, at least up to the region of the sleeves 126 covering the upper arm above the elbow, and the elbow region (as shown). In a different example, the sleeves 126 may comprise the same elastic material as the partial shrug-like portion all the way to the wrist potion. In yet a different example of the present invention, the sleeves 126 may be convertible between a short sleeve and a long sleeve, for example by having a zipper with a zipper flap covering the zipper, dividing the sleeves 126, just above the elbow, into an upper sleeve and lower sleeve. The zipper may be used to attach or detach the lower-sleeve portion from the upper-sleeve portion of the jacket/coat 100, at the convenience of the user.

Moving on to the construction of the jacket/coat 100 in accordance with the present invention, the vest portion 110 comprising the full-length of the jacket/coat 100, may be placed over and attached to the partial shrug-like portion 120 at the bottom rounded edge 122, and side edges 123 of the partial shrug-like portion 120. Only the front edge 127 of the sleeves 126 may be attached to the front edge 113 of the armhole 112 in the vest portion 110. In other words, there may be no seams on the back and shoulders of the jacket/coat 100 in accordance with the present invention. Therefore, since essentially, a "pocket" (accessible at the shoulders from the back) is formed between the partial shrug-like portion 120 and the vest portion 110, perforations 114 are provided on the vest portion 110 slightly above the seam with the bottom rounded edge 122 of the partial shrug-like portion 120. The perforations 114 may serve as a water-draining mechanism in case water slips into the "pocket" in the event that the jacket/coat is worn during rainy weather.

The jacket/coat 100 in accordance with the present invention may be made from a combination of water-resistant fabrics that may have additional differing properties such as added elasticity. Elasticity in such a fabric may be substantially multi-directional or may be operative only in some directions. For example, one or more material used in constructing a garment in accordance with the present invention may comprise a four-way stretch textile, a two-way stretch textile, or other materials with desired properties. Textiles used may provide desired stretch properties based upon material selection, such as spandex and/or spandex blends, and/or structural properties, such as knits providing a degree of mechanical stretch. If a textile with predominantly two-way stretch along a single axis is chosen, that axis may be oriented substantially horizontally when the jacket is worn, as indicated at 160, or at any bias to horizontal, as indicated at 162 and 164. Optionally, different textile portions used in constructing a jacket in accordance with the present invention may have different stretch properties and/or different orientations. Further, the fabrics may comprise an elastomer water-proofing coating material, optionally with at least the same elastic characteristics as the fabrics themselves. The different seams for constructing the jacket/coat 100 in accordance with the present invention may be formed by stitching, welding (using adhesive materials), or a combination of both.

Figure 2:
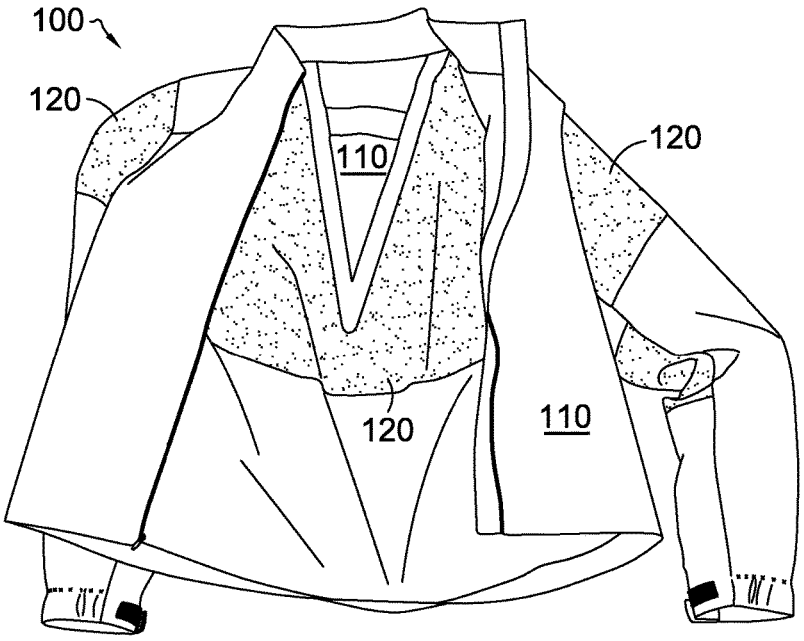
FIG. 2 is a layered front view of the exemplary jacket/coat shown in FIG. 1.
Figure 3:
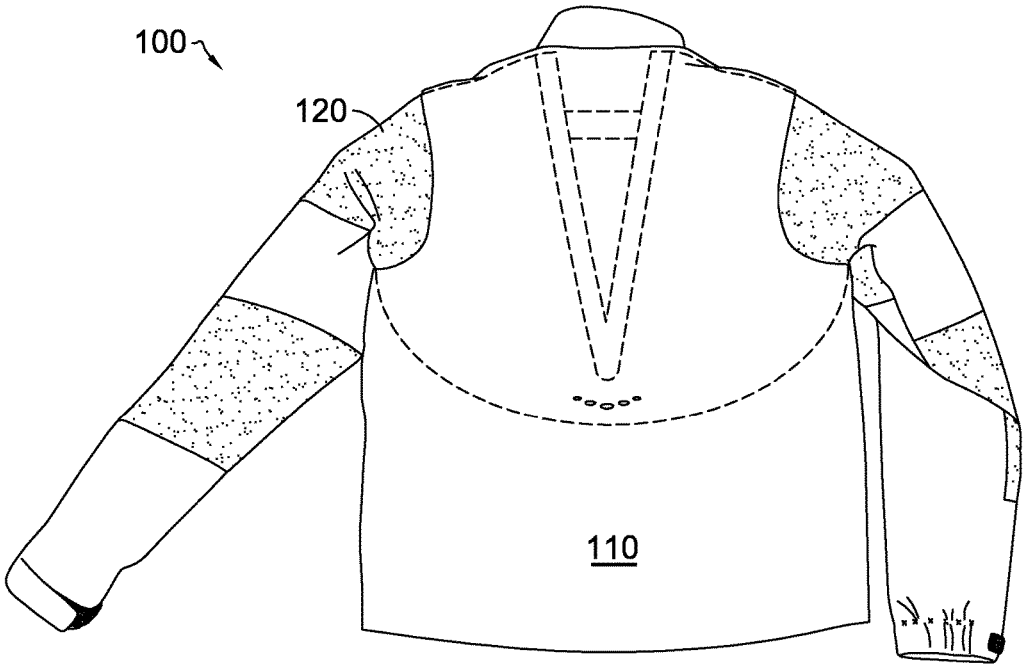
FIG. 3 is a layered back view of the exemplary jacket/coat shown in FIG. 1.
Figure 4:
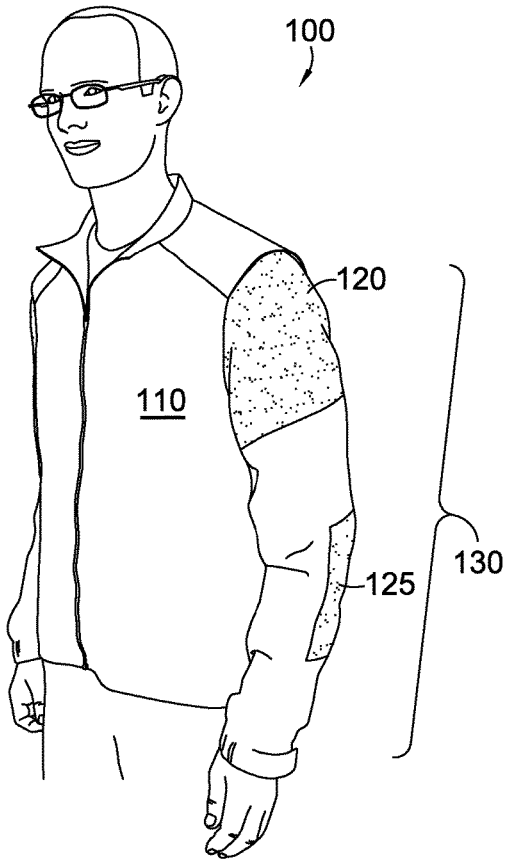
FIGS. 4-6 are different views of the exemplary jacket/coat shown in FIG. 1 as worn by an individual.
Figure 5:
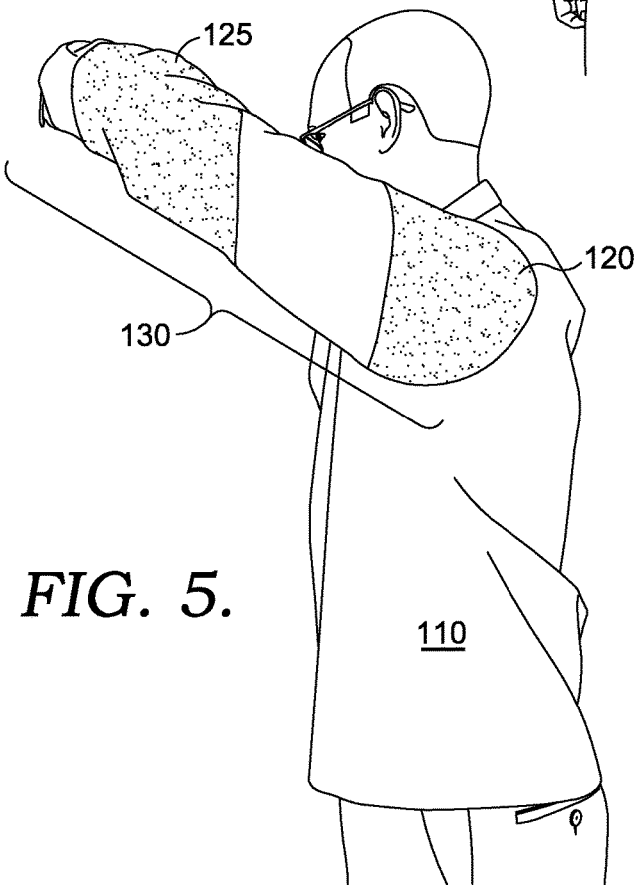
Figure 6:
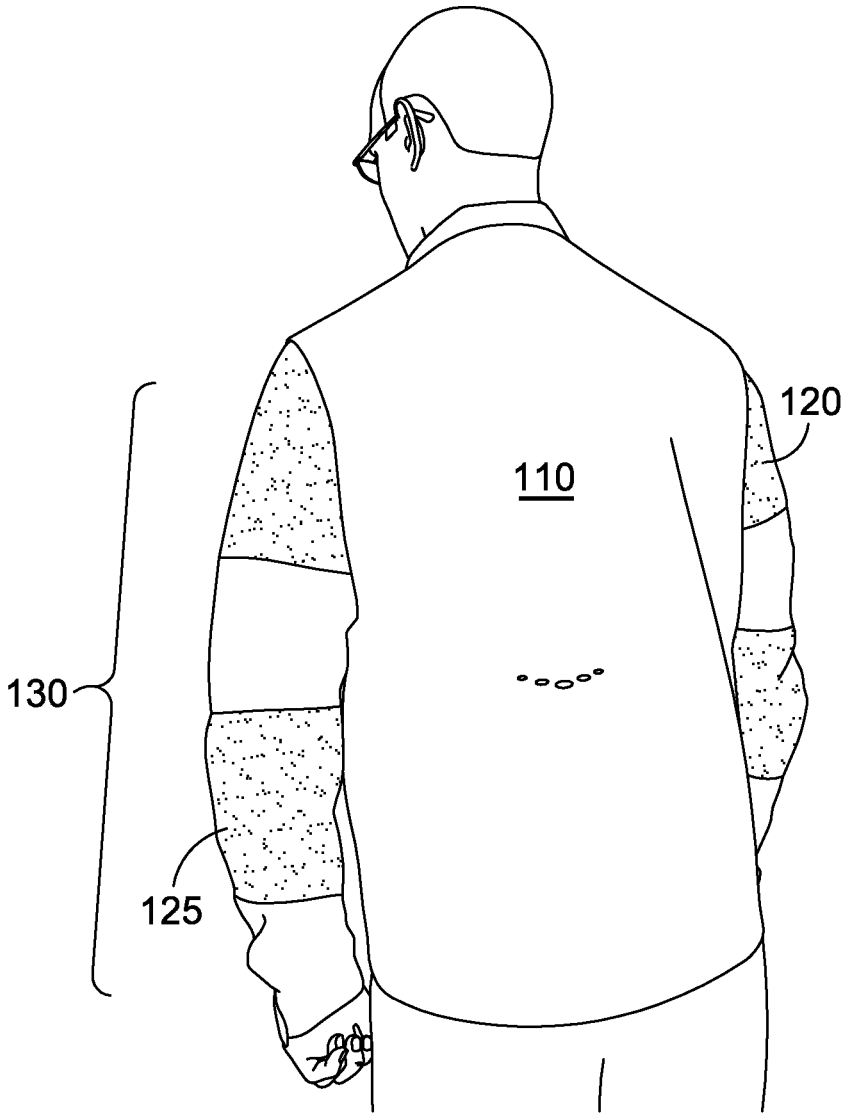

FIGS. 2 and 3 show front and back views, respectively, of the constructed jacket/coat 100 in accordance with the present invention. FIG. 3, in particular, shows how the partial shrug-like portion 120 and the vest portion 110 align with each other in the jacket/coat in accordance with the present invention. Further, FIGS. 4-6 show the jacket/coat 100 in accordance with the present invention as worn by a user. As observed from FIGS. 4-6, the jacket/coat 100 in accordance with the present invention provides an enhanced range of motion for the arms and back of a user by providing an elastic partial shrug-like portion 120 with a strain-relieving cutout 130 and, and by eliminating the shoulder and sleeve seams. Therefore, the jacket/coat construction in accordance with the present invention, may allow the back of the garment to expand and contract as needed with any type of movement by the user.

Since the vest portion 110 of the jacket/coat in accordance with the present invention determines the length of the jacket/coat, the vest portion may have any length desired for the particular style of jacket/coat desired. For example, the vest portion 110 may have any desired length, for example waist-length, hip-length, thigh-length, or any other length in between, or longer.

Figure 7:
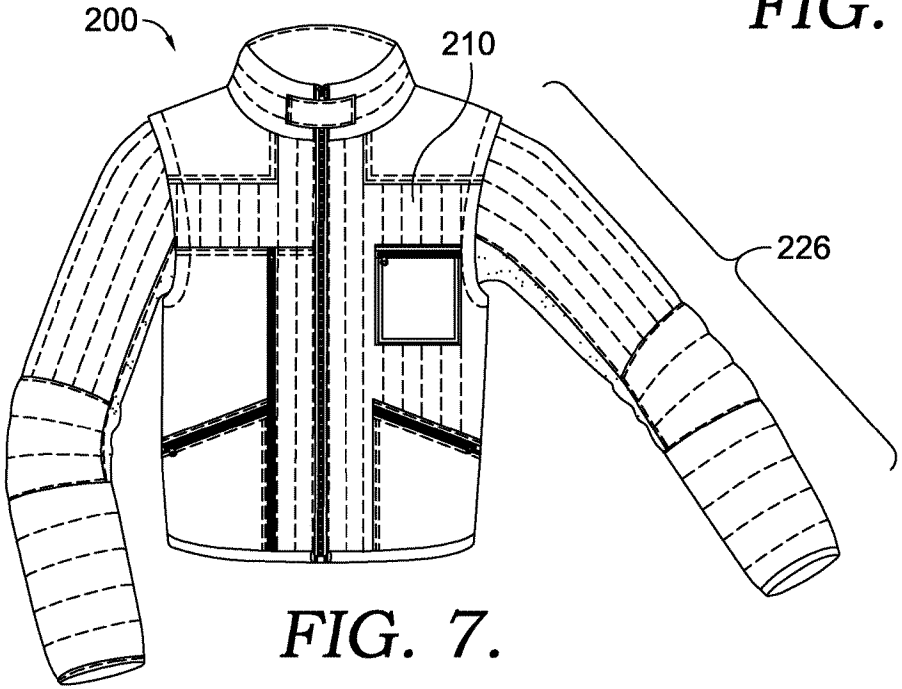
FIG. 7 is a front view of a different constructed exemplary jacket/coat in accordance with the present invention.

In reference to FIG. 7, another example jacket/coat 200 in accordance with the present invention is shown. As shown in FIG. 7, the jacket/coat 200 may have a vest portion 210 over a vest shrug-like portion 220 (not shown), with the sleeves 226 attached to it. The jacket/coat 200 may be thinly quilted with thermal fibers (synthetic or down), to provide some insulation in cold weather. Further, the outer shell of the jacket/coat 200 may be constructed from water-resistant or water-proof fabrics in combination with elastic fabrics that may or may not be waterproof.

Figure 8A:
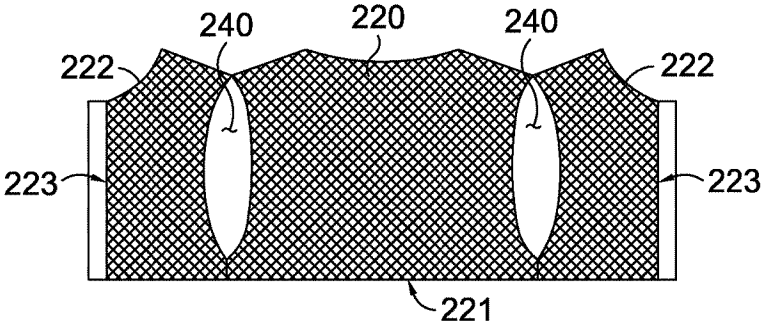
FIGS. 8A and 8B are deconstructed views of exemplary jacket/coat in FIG. 7.
Figure 8B:
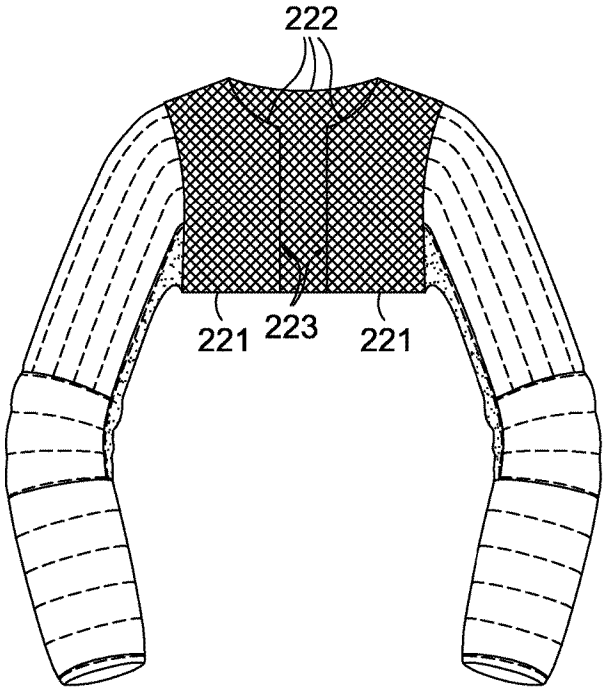

The vest shrug-like portion 220 is shown in FIG. 8A. The vest shrug-like portion 220 may comprise a resilient, yet flexible mesh-type material. The vest shrug-like portion 220 has two armholes 240 where the sleeves 226 are attached. Further, the vest shrug-like portion 220 comprises a bottom edge 221, collar edges 222, and two front edges 223, which represent the points of connection with the outer vest portion 210 when the jacket/coat 200 is constructed. In FIG. 8B, the vest shrug-like portion 220 with sleeves 226 attached is shown. As it can be clearly seen in FIG. 8B, the sleeves 226 have the same thinly quilted construction as the vest portion 210 and thus provide the same level of insulation as the vest portion 210. Further, the sleeves 226 may comprise a flexible and stretchable fabric material under the arm extending to the elbow region to provide enhanced flexibility in this region, especially when lifting the arms and bending the elbows.

Figure 10:
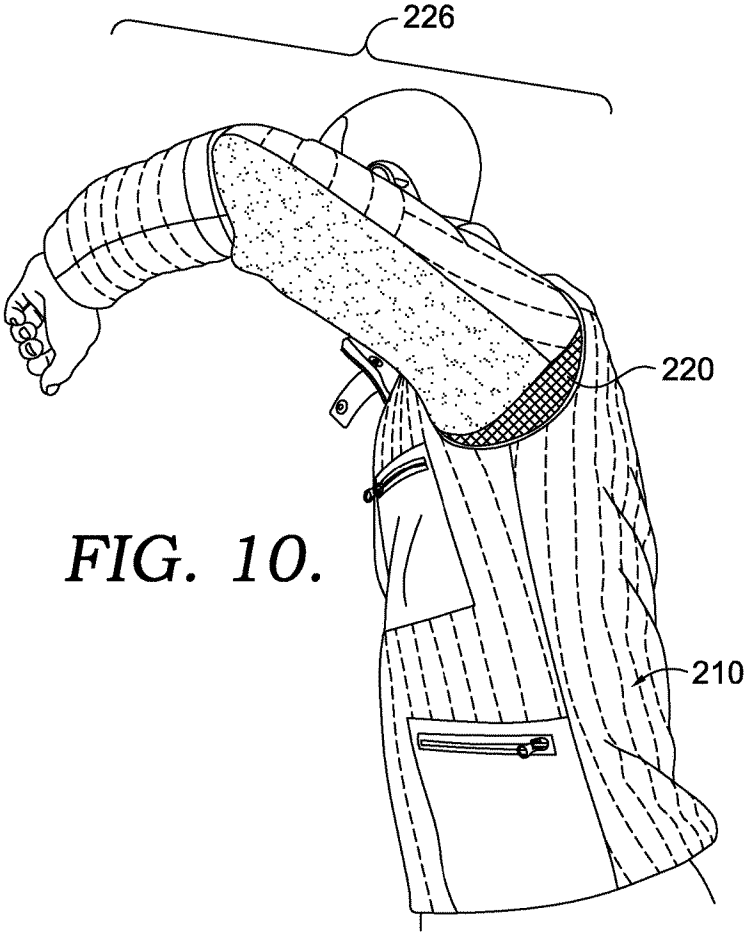
FIGS. 9 and 10 are different views of the exemplary jacket/coat shown in FIG. 7, as worn by an individual.
Figure 9:
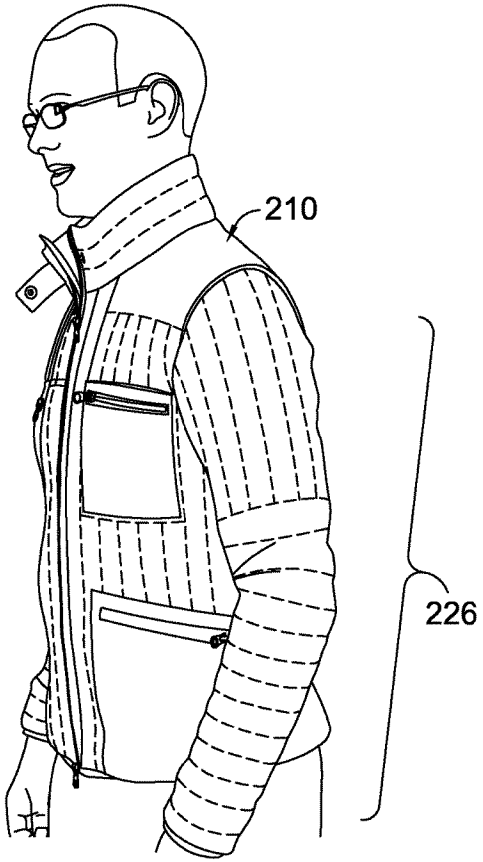

Additionally, as it can be seen in FIGS. 9 and 10, when a user is wearing the jacket/coat 200 in accordance with the present invention, the jacket/coat 200 not only protects the wearer from cold weather, but it does not impede the range of motion for the user because there are no seams at the sleeves and shoulders between the vest shrug-like portion 220 and the vest portion 210. Also, because of the flexible mesh construction of the vest shrug-like portion 220, temperature regulation is enhanced due to the possible airflow between the inside and the outside of the jacket/coat 200.

As the jacket/coat 100 presented in FIG. 1, the length of the jacket/coat 200 in FIG. 7 is determined by the length of the vest portion 210. Thus, the vest portion 210 may be of any length desired for the particular style or need for the jacket. For example, the vest portion 210 may be waist-length, hip-length, thigh-length, knee-length, or any other length in between, or longer.

Figure 11:
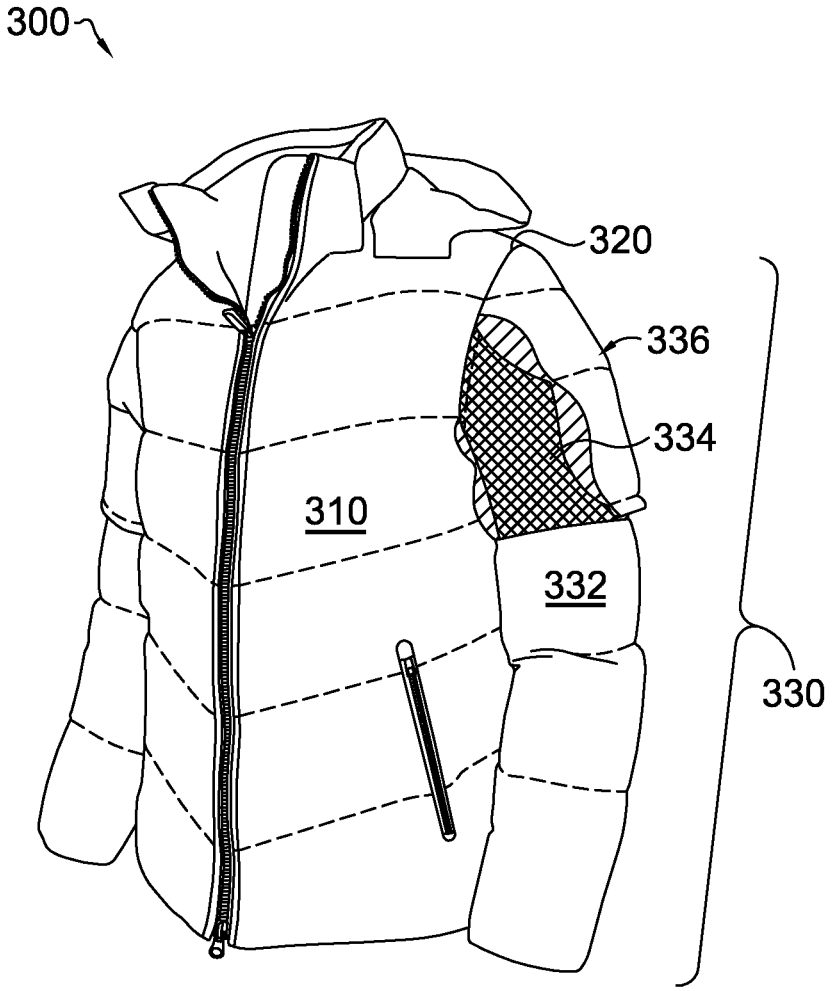
FIG. 11 is a view of a different jacket/coat in accordance with the present invention showing the construction of the sleeve comprising a lower sleeve and an upper sleeve.
Figure 13:
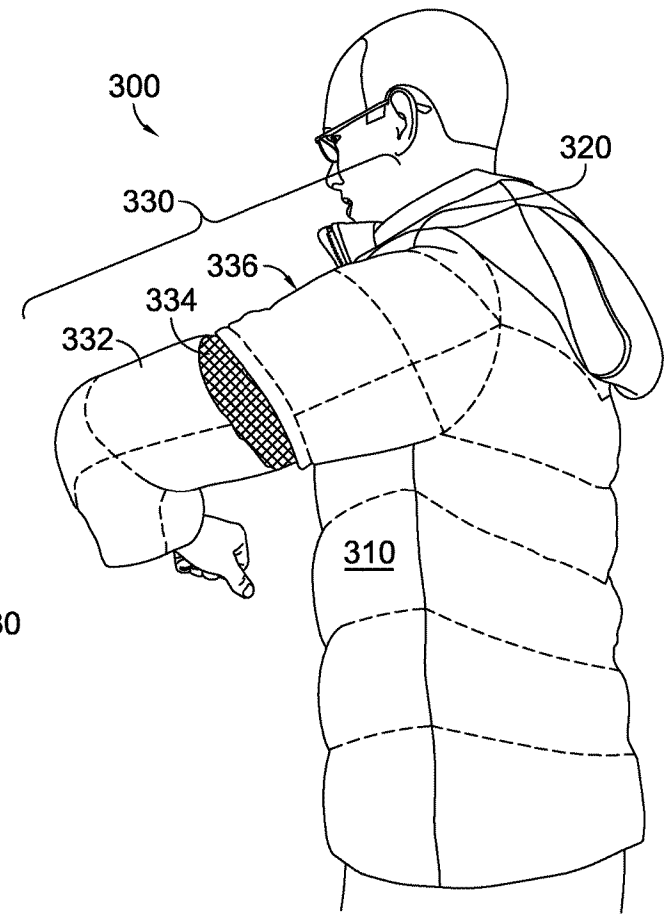
FIGS. 12 and 13 are different views of the exemplary jacket/coat shown in FIG. 11, as worn by an individual.
Figure 12:
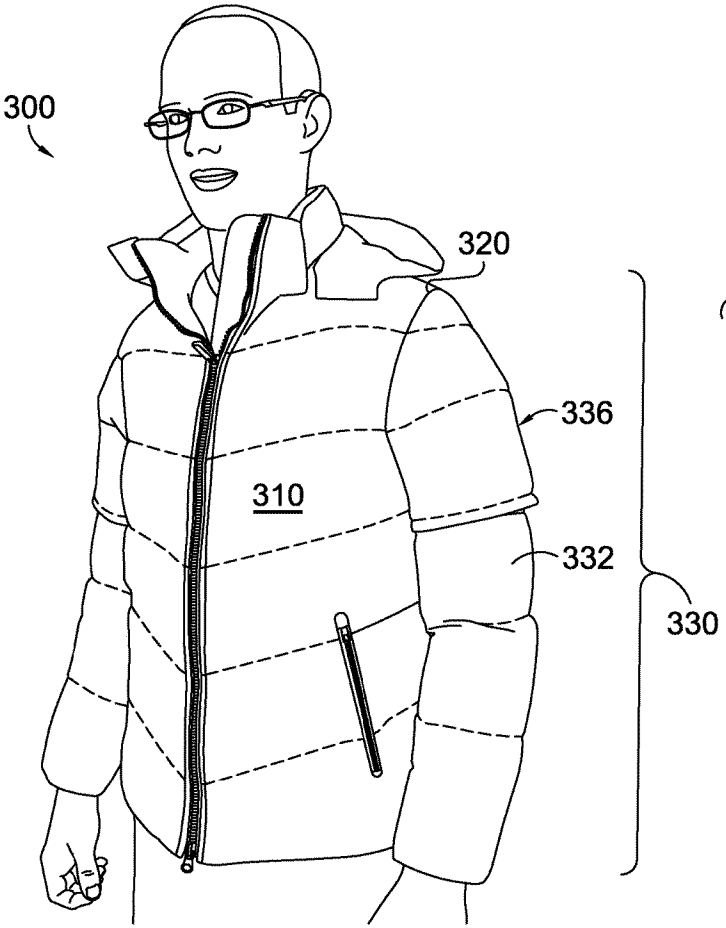

In yet a further example of the jacket/coat in accordance with the present invention, a thick winter jacket/coat 300 is shown in FIGS. 11-13. Since winter jackets tend to be bulky for insulating against cold weather, inevitably, they may have limited breathability and, may be restrictive and not allow a user full range of motion for his/her arms and shoulders. Therefore, in the jacket/coat 300 in accordance with the present invention, a composite sleeve 330 is provided, which may provide breathability and enhanced range of motion without compromising insulation from cold weather. In other words, the sleeves 330 may comprise three different sections: a lower sleeve 332, an upper sleeve 334 and a cover sleeve 336. The lower sleeve 332 may be constructed in the same way as the rest of the jacket/coat 300 using the same materials, including the insulating fibers, and may cover an arm from the wrist up to and including the elbow. Then, the upper sleeve 334 comprising a flexible and resilient mesh-type material, may be attached to the lower sleeve 332 by a seam above the elbow, and may cover the arm up to the shoulder, and be attached to the jacket/coat 300 at the seam around the armhole 320.

Finally, the cover sleeve 336 may also be constructed from the same materials as the rest of the jacket/coat 300, including the insulating fibers. The cover sleeve 336 may be attached to the rest of the jacket/coat 300 by a seam 320 connecting it to the armhole of the jacket/coat 300. The cover sleeve 336 may extend from the shoulder to slightly below the upper sleeve 334, completely concealing the upper sleeve 334 when the arm of a user is in a rest position parallel to the user's body. It may be noted that the length ratios of the upper sleeve 334 and lower sleeve 332 may be other than the one described above. Also, the length of the cover sleeve 336 may also change accordingly, to conceal the upper sleeve 334.

FIG. 12 shows the jacket/coat 300 as worn by a person with his arms in a rest position. As it can be observed, the upper sleeve 334 of the sleeve 330 is completely concealed by the cover sleeve 336. FIG. 13 shows how the mesh-type material comprising the upper sleeve 334 may stretch when the wearer bends his/her arms, therefore relieving strain on the garment.

The jacket/coat 300 with the composite sleeves 330 in accordance with the present invention, may allow for improved airflow between the inside and outside of the jacket/coat 300 and enhanced flexibility for a user due to the flexibility provided by the mesh material comprising the upper sleeve 334, keeping the user more comfortable. In other words, the composite sleeve construction in accordance with the present invention may provide enhanced temperature regulation, as well as an enhanced range of motion for the user.

Further, just like the jackets presented above, the jacket/coat 300 in accordance with the present invention may be of different lengths according to the style and coverage desired. For example, the jacket/coat 300 may be waist-length, hip-length, thigh-length, knee-length, or any other length in between, or longer.

Figure 16:
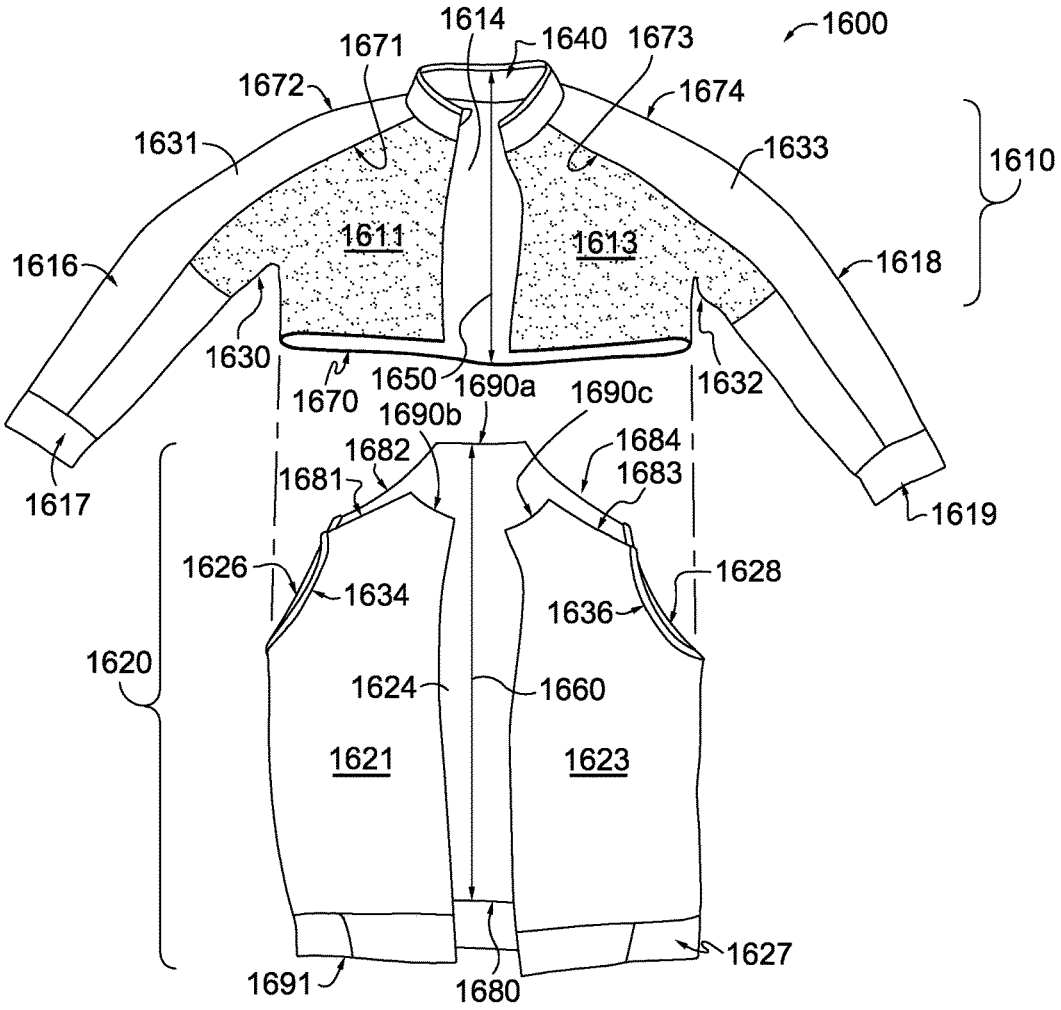
FIG. 16 is a deconstructed view of an exemplary garment in accordance with the present invention.
Figure 17:
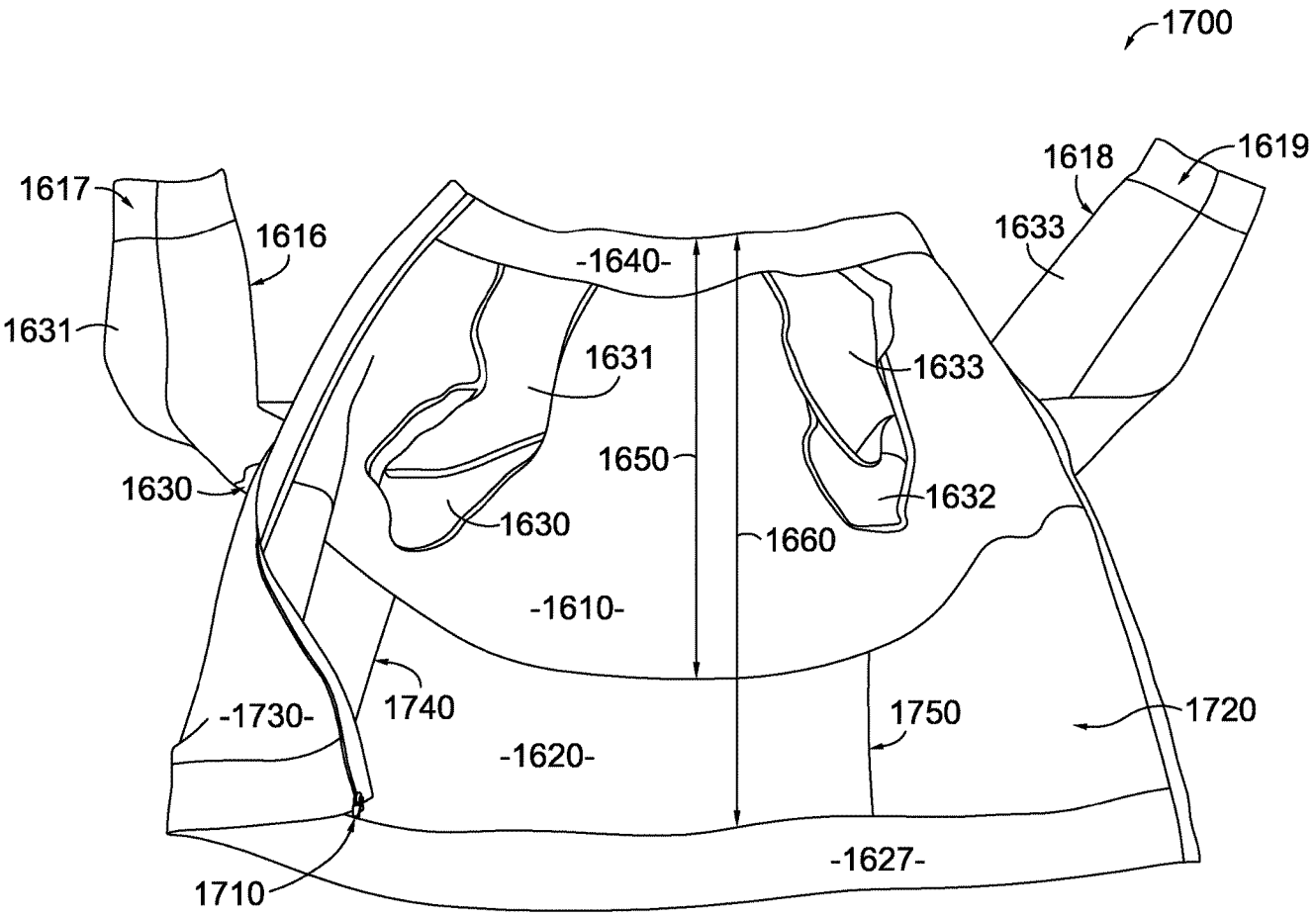
FIG. 17 is an open view of the assembled garment shown in FIG. 16 in accordance with the present invention.

In yet a different example in accordance with the present invention, a deconstructed view of a garment 1600 is shown in FIG. 16. Garment 1600 comprises a shrug component 1610 and a vest component 1620, where the vest component 1620 is configured to extend over or overlay the shrug component 1610. The shrug component 1610 comprises one or more front panels 1611/1613, one or more back panels 1614, and two sleeves 1616 and 1618, wherein the sleeves 1616/1618 may be long sleeves (as shown), ¾ sleeves, or short sleeves. The vest component 1620 comprises one or more front panels 1621/1623 and one or more back panels 1624. The one or more front panels 1621/1623 may be affixed to the one or more back panels 1624 at side seams 1740 and 1750 as shown in FIG. 17 to form in part two armholes or partial U-shaped armholes 1626 and 1628 having armhole perimeters 1634 and 1636 respectively. In the alternative, the vest component 1620 may be formed from a single piece of textile material cut into the respective shape needed to form the vest component 1620 seamlessly. When the shrug component 1610 and the vest component 1620 are assembled together to form garment 1600, a right sleeve 1616 extends through the right armhole 1626, and the left sleeve 1618 extends through the left armhole 1628.

The garment 1600 is assembled by affixing front shoulder portion 1681 of the vest component 1620 to a front shoulder portion 1671 of the shrug component 1610, affixing a back shoulder portion 1682 of the vest component 1620 to a back shoulder portion 1672 of the shrug component 1610, affixing a front shoulder portion 1683 of the vest component 1620 to a front shoulder portion 1673 of the shrug component 1610, and affixing a back shoulder portion 1684 of the vest component 1620 to a back shoulder portion 1674 of the shrug component 1610. The front and back shoulder portions 1681, 1682, 1683, and 1684 of the vest component 1620 may be affixed to the front and back shoulder portions 1671, 1672, 1673, and 1674 of the shrug component 1610 by stitching, heat pressing, adhesive bonding, or any other suitable means or combination of means to form a permanent bond in accordance with the present invention.

Further, the garment 1600 may be assembled by affixing the shrug component 1610 to the vest component 1620 at a collar portion 1640 of the shrug component 1610 and collar portions 1690 *a, b*, and *c* of the vest component 1620. The shrug component 1610 may be further affixed to vest component 1620 by affixing a bottom edge/margin 1670 of the shrug component 1610 to an interior surface of the front and back panels 1621, 1623, and 1624 of the vest component 1620 at a distance above the bottom edge/margin 1680 of the vest component 1620. To put it another way, a distance 1650 from the collar 1640 to the bottom edge/margin 1670 of the shrug component 1610 may be less than a distance 1660 between the collar portions 1690 *a, b*, and *c* to the bottom edge 1680 of the vest component 1620. The bottom edge 1670 of the shrug component 1610 may be affixed to the vest component 1620 by stitching, heat pressing, adhesive bonding, or any other suitable means, or combination of means to form a permanent bond in accordance with the present invention.

However, in accordance with the present invention, the bottom/inferior sleeve portions 1630 and 1632 of the shrug component 1610 are not affixed to the armhole perimeters 1634 and 1636 of the vest component 1620. This allows a wearer of the garment 1610 to have full mobility when, for example, the wearer reaches his/her arms forward, backward, and/or upward. In other words, by not affixing the bottom/inferior sleeve portions 1630 and 1632 of the shrug component 1610 to the armhole perimeters 1634 and 1636 of the vest component 1620, the vest component 1620 does not impede or restrain movement of the sleeves 1616/1618 of the shrug component 1610 when the garment 1600 is worn.

Figure 18:
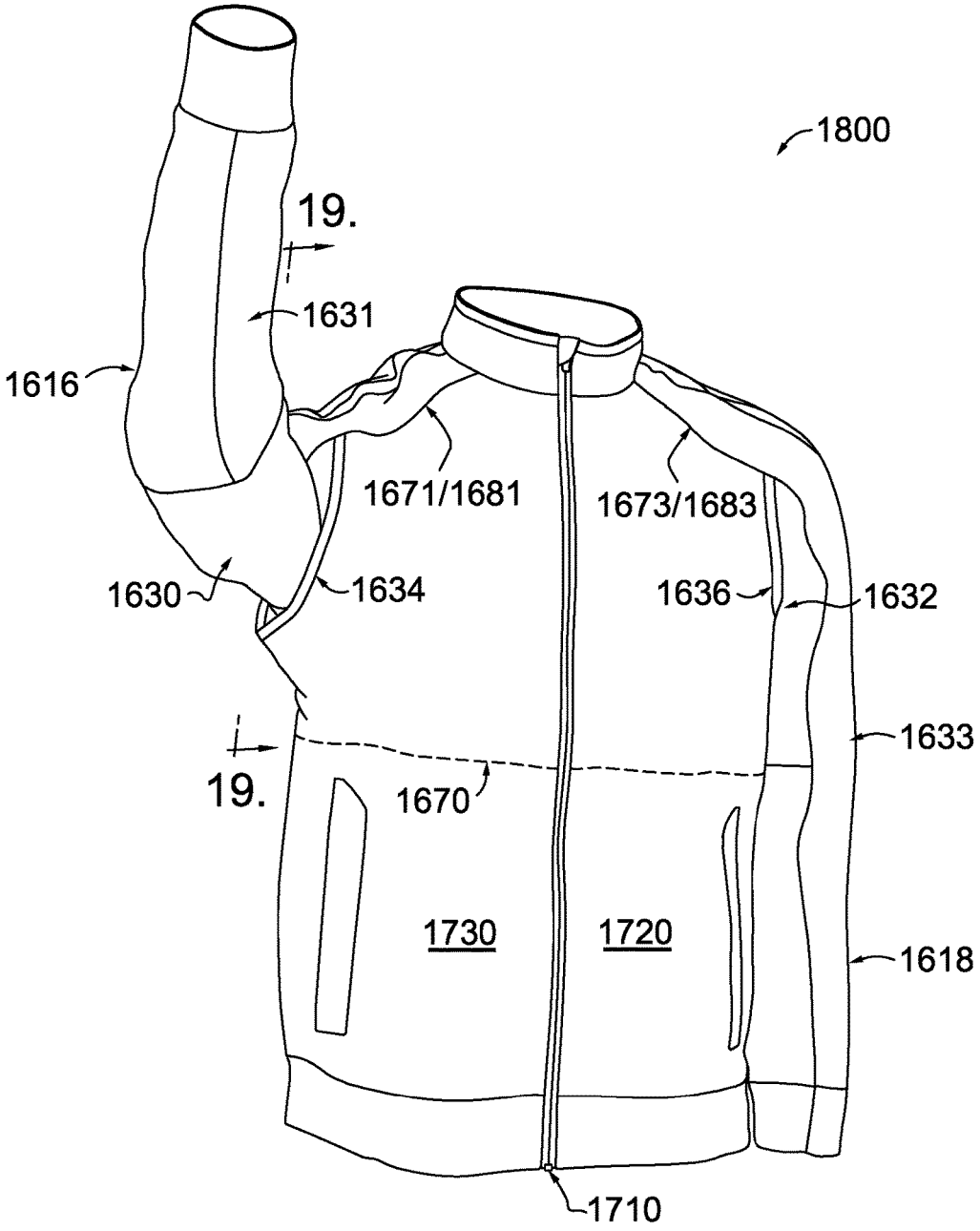
FIG. 18 is a closed view of the assembled garment shown in FIGS. 16 and 17 in accordance with the present invention.

In embodiments in accordance with the present invention where the garment 1600 is a front opening jacket (as shown in FIGS. 16-18), the shrug component 1610 may further be affixed to the vest component 1620 at a location where a closing mechanism extending from the collar 1640/1690 to the bottom edge 1680, or a garment bottom edge 1691 of the vest component 1620, is provided. As shown in FIG. 17, the closing mechanism 1710 may serve to releasably affix the front right panel 1730 of the garment 1600 to the left front panel 1720 of the garment 1600. The closing mechanism 1710 may comprise for example, a zipper, buttons, hook-and-loop type mechanisms, or any other suitable means for providing an easy open and close function to the garment 1600.

In exemplary aspects, the shrug component 1610 may comprise a first textile material that is more elastic than a second textile material comprising the vest component 1620. For example, the shrug component 1610 may comprise elastane, Lycra®, elastic polyester, elastic nylon, or any other suitable textile material, in accordance with the present invention. The vest component 1620 may comprise a material that is less elastic than the shrug component 1610. The vest component may comprise natural and/or synthetic fibers such as cotton, hemp, bamboo, polyester, nylon, plastic, thermoplastic polyurethane, or any other suitable material. The material of the vest component may be a material that is treated to be or is naturally waterproof, water resistant, and/or water repellent. Further, the sleeves 1616/1618 of the shrug component 1610 may comprise the same textile material as the shrug component 1610, the same textile material as the vest component 1620, or in the alternative, the sleeves 1616/1618 may comprise sleeve portions of the first textile material of the shrug component 1610 (where higher elasticity would be advantageous for better comfort and higher range of mobility), and other sleeve portions of the second textile material of the vest component 1620 (where the properties of the textile material of the vest component 1620 would be more desirable, such as the forearm portion of the sleeves in a long sleeve embodiment, as shown). For example, superior sleeve portions 1631/1633 of the shrug component 1610 may comprise the second textile material of the vest component 1620 and inferior sleeve portions 1630/1632 of the shrug component 1610 may comprise the first textile material of the shrug component 1610. Additionally, the sleeves 1616/1618 may comprise additional structural, functional, and/or decorative features to complement the garment 1600.

In different aspects in accordance with the garment 1600, the shrug component 1610 may comprise a first material having a first color, the first material having a first elasticity. The first color of the first material may be a single color, a combination of colors, a patterned textile material, a textile material having different designs such as a team logo, favorite character, landscape, etc. The vest component 1620 may comprise a second material having a second color, the second material having a second elasticity. The second color of the second material may be a single color, a combination of colors, a patterned textile material, a textile material having different designs, etc. The second textile material may or may not be transparent or see-through. If see-through, a design/pattern on the vest component 1620 may be configured to be complementary to a design/pattern on the shrug component 1610.

The garment 1600 may be a long jacket (extending substantially below the waistline of a wearer when worn), a short jacket (extending above the waistline of a wearer when worn), or a waist length jacket (extending around the waistline of a wearer when worn), as shown. The garment 1600 may further comprise cuffs 1617 and 1619 and a waistband 1627 of a third material, wherein the third material comprises an elasticity that is greater than or equal to the elasticity of the first material forming the shrug component 1610. The cuffs 1617/1619 and the waistband 1627 may aid in providing a comfortable fit of the garment 1600 when the jacket is worn. For example, the cuffs 1617/1619 and the waistband 1627 may aid in keeping the garment in place, as desired by the wearer, when the jacket is worn.

FIG. 17 shows an open configuration 1700 of the garment 1600 in accordance with the present invention. As described above, superior sleeve portions 1631/1633 of sleeves 1616/1618 of the shrug component 1610 may comprise a material that is equal to or similar to the material of the vest component 1620, and the material of inferior sleeve portions 1630/1632 may comprise a material that is the same as or similar to the material of the shrug component 1610, where the material of the shrug component 1610 is more elastic than the material of the vest component 1620.

FIG. 18 shows a closed configuration 1800 of the garment 1600 in accordance with the present invention. As seen in FIG. 18, the vest component 1620 and the shrug component 1610 are affixed at the front shoulder portions 1671/1681 and the back shoulder portions 1672/1682 (not shown) of the vest component 1620 and the shrug component 1610, but the inferior sleeve portions 1630/1632 of the shrug component 1610 are not affixed to the arm hole perimeter portions 1634/1636 of the vest component. This feature of the present invention is described in more detail below in relationship to FIG. 19.

Figure 19:
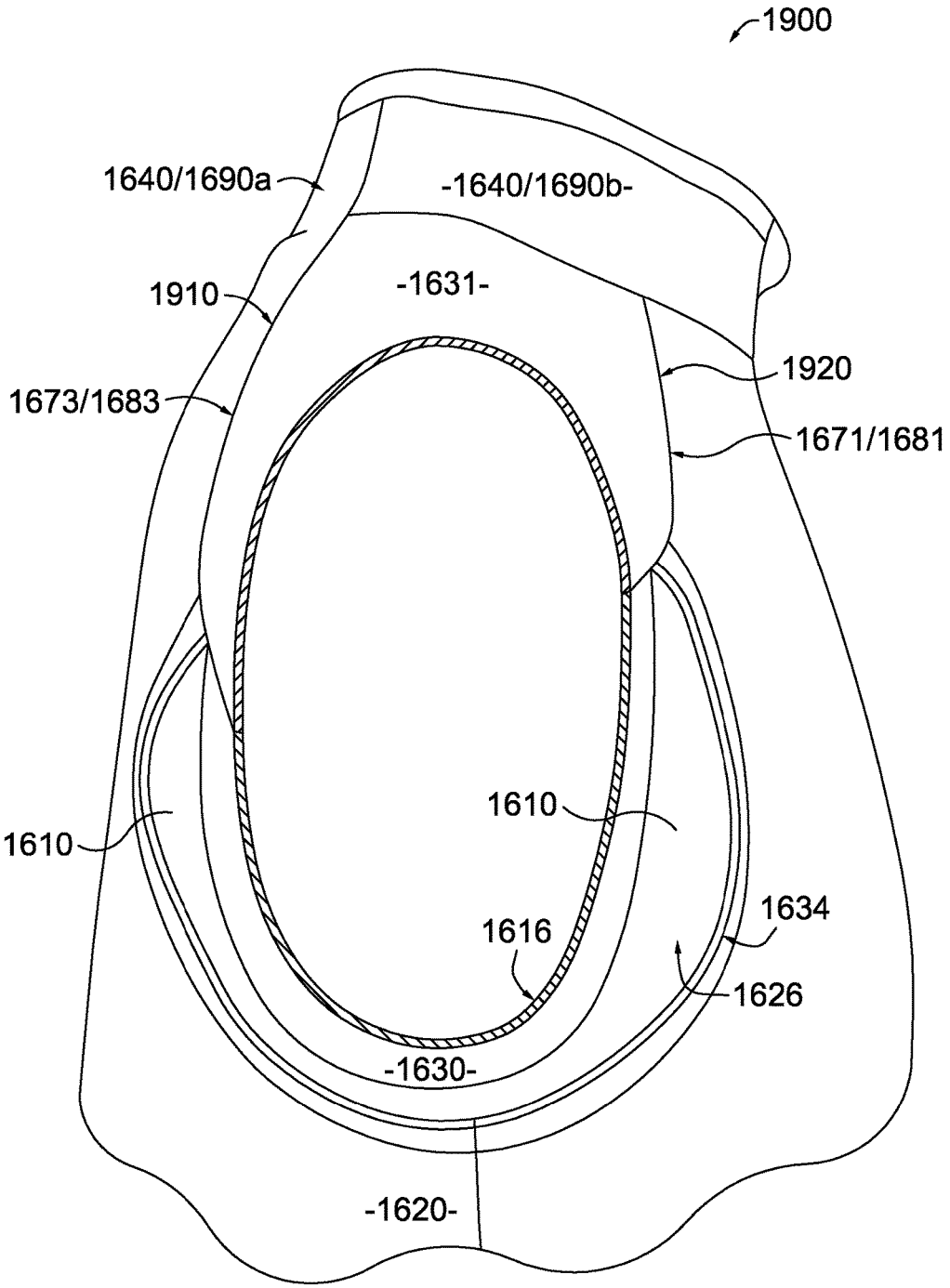
FIG. 19 is a cross-sectional view of the garment shown in FIG. 18 along the line 19-19 in accordance with the present invention.

FIG. 19 is a cross section along the line 19-19 in FIG. 18 in accordance with aspects herein. As seen in more detail in FIG. 19, the right sleeve 1616 of the shrug component 1610 comprises a superior sleeve portion 1631 and an inferior sleeve portion 1630. The vest component 1620, as described above, is fixedly or permanently attached at front shoulder portions 1671/1681 and back shoulder portions 1673/1683 of the shrug component 1610 and the vest component 1620. The attachment points or area on the front shoulder portions 1671/1681 and back shoulder portions 1673/1683 may be defined by a back seam 1910 and a front seam 1920. Further, in accordance with the present invention, in FIG. 19 it can be seen that the superior sleeve portion 1631 is depicted as a single layer of material, and the vest component 1620 forms a partial armhole 1626 that has a U-shaped armhole perimeter 1634 as defined by the front panel 1621 and the back panel 1624 of the vest component 1620, where the inferior sleeve portion 1630 of the shrug component 1610 is not attached to the U-shaped perimeter 1634 of the armhole 1626 of the vest component 1620. The superior sleeve portion 1631 of the shrug component 1610, however, is shared with the vest component 1620 when the garment 1600 is assembled. Similarly, as described above, the left sleeve 1618 may be constructed in the same way as the right sleeve, forming a U-shaped armhole perimeter 1636 as defined by the front panel 1623 and the back panel 124 of the vest component 1620, where the inferior sleeve portion 1632 of the shrug component 1610 is not attached to the U-shaped perimeter 1636. In a different embodiment in accordance with the present invention (not shown) the vest component may comprise a full armhole, defined by an enclosed perimeter, where the shrug component and the vest component may be attached along a top shoulder seam of both the vest component and the shrug component, and detached at remainder portions of the armhole perimeter of the vest component and sleeve portions of the shrug component.

Although garment 1600 is depicted in FIGS. 16-19 as being an openable jacket with a front zipper, the garment 1600 may be a pullover garment with a crew neck, V-neck, or a zippered collar, a hoodie, a t-shirt, a shirt type, or any other type of garment that would benefit from the improved range of motion provided by the configuration of garment 1600 described herein.

Figure 20:
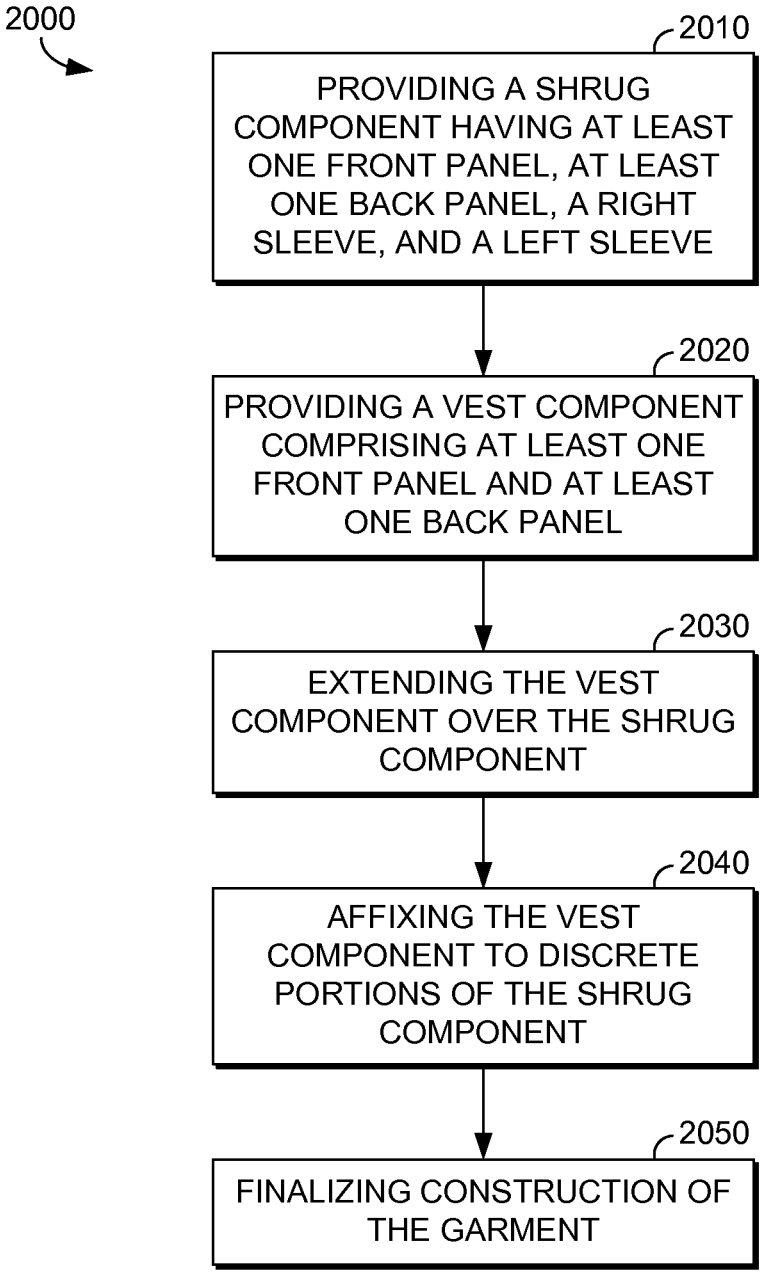
FIG. 20 is a flow chart of an exemplary method of manufacturing the garment shown in FIGS. 16-19.

FIG. 20 depicts a flow chart outlining a method 2000 for manufacturing a garment, such as the garment 1600 shown in FIGS. 16-19 in accordance with aspects herein. The method 2000 starts by the step 2010 of providing a shrug component of a first material, which depending on the configuration of the garment, may comprise, one or more front panels, one or more back panels, a right sleeve, and a left sleeve. The sleeves may be formed continuously with the one or more front and back panels, or may be formed from separate panels attached to the shrug component by seams. The seams for forming the shrug component may be formed by stitching, adhesive bonding, heat pressing, or any other suitable method for forming seams in a garment. The sleeves of the shrug component may comprise the same material of the shrug component, or in the alternative, may comprise two or more materials with different physical properties. Next, the method comprises the step 2020 of providing a vest component of a second material, which depending on the configuration of the garment, may comprise, one or more front panels and one or more back panels that form in part a right armhole and a left armhole. Then, the method continues with the step 2030 of extending the vest component over the shrug component so that the right sleeve of the shrug component extends through the right armhole of the vest component and the left sleeve of the shrug component extends through the left armhole of the vest component. Subsequently, the method continues with the step 2040 of assembling the garment by affixing the vest component to discrete portions of the shrug component while not affixing the shrug component to the vest component at inferior sleeve portions of the shrug component. And, construction of the garment is finalized at step 2050 by providing finishing touches to the garment such as cuffs, waistbands, and zippers.

From the foregoing, it will be seen that this invention is one well adapted to attain all the ends and objects hereinabove set forth together with other advantages, which are obvious and inherent to the structure.

It will be understood that certain features and subcombinations are of utility and may be employed without reference to other features and subcombinations. This is contemplated by and is within the scope of the claims.

Since many different garment styles may be made of the invention without departing from the scope thereof, it is to be understood that all matter herein set forth or shown in the accompanying drawings is to be interpreted as illustrative and not in a limiting sense.

The invention claimed is:

1. A jacket comprising:

a shrug component comprising at least a shrug back panel, a first sleeve extending from the shrug back panel, and a second sleeve extending from the shrug back panel, wherein each of the first sleeve and the second sleeve comprises a superior sleeve portion and an inferior sleeve portion, wherein the superior sleeve portion of each of the first sleeve and the second sleeve comprises a front shoulder portion and a back shoulder portion; and a vest component extending over the shrug component, the vest component comprising:

one or more vest front panels, and one or more vest back panels, wherein:

the one or more vest front panels are affixed to the one or more vest back panels at a pair of side seams, the one or more vest front panels and the one or more vest back panels form a first U-shaped armhole and a second U-shaped armhole, wherein each of the first and second U-shaped armholes comprise an open end and a closed end, wherein the open end is located superior to the closed end, the one or more vest front panels comprise a front shoulder edge that extends from a collar opening of the jacket to a front portion of the open end of the respective first U-shaped armhole and the second U-shaped armhole, the one or more vest back panels comprise a back shoulder edge that extends from the collar opening of the jacket to a back portion of the open end of the respective first U-shaped armhole and the second U-shaped armhole, the first sleeve of the shrug component extends through the first U-shaped armhole and the second sleeve of the shrug component extends through the second U-shaped armhole, the front shoulder edge of the one or more vest front panels is affixed to the front shoulder portion of the respective superior sleeve portion of the first sleeve and the second sleeve of the shrug component, the back shoulder edge of the one or more vest back panels is affixed to the back shoulder portion of the respective superior sleeve portion of the first sleeve and the second sleeve of the shrug component, and the inferior sleeve portion of the respective first sleeve and the second sleeve of the shrug component is not affixed to the respective closed end of the first U-shaped armhole and the second U-shaped armhole.

2. The jacket of claim 1, wherein the shrug component comprises a first material and a second material and the vest component comprises the second material.

3. The jacket of claim 2, wherein the first material is more elastic than the second material.

4. The jacket of claim 2, wherein the second material is a water resistant material.

5. The jacket of claim 2, wherein the superior sleeve portion of each of the first sleeve and the second sleeve is comprised of the first material, and the inferior sleeve portion of each of the first sleeve and the second sleeve is comprised of the second material.

6. The jacket of claim 1, wherein the one or more vest front panels comprise a vest front right panel and a vest front left panel.

7. The jacket of claim 6, wherein a bottom edge of the shrug component is affixed to the vest front right panel, the one or more vest back panels, and the vest front left panel of the vest component at a first distance from a collar of the jacket.

8. The jacket of claim 7, wherein the shrug component is further affixed to the vest component at the collar of the jacket.

9. The jacket of claim 8, wherein the jacket comprises a closing mechanism extending from the collar to a bottom edge of the vest component, to releasably affix the vest front right panel to the vest front left panel.

10. The jacket of claim 9, wherein the closing mechanism comprises a zipper.

11. A method for manufacturing a garment comprising:

forming a shrug component comprising at least one front panel, at least one back panel, a first sleeve having a first superior sleeve portion and a first inferior sleeve portion, and a second sleeve having a second superior sleeve portion and a second inferior sleeve portion, wherein the each of the first superior sleeve portion and the second superior sleeve portion comprise a front shoulder portion and a back shoulder portion;

forming a vest component comprising at least one front panel, and at least one back panel by affixing the at least one front panel and the at least one back panel at a pair of side seams, wherein when affixed at the pair of side seams, the at least one front panel and the at least one back panel cooperate to form a first U-shaped armhole and a second U-shaped armhole, wherein each of the first and second U-shaped armholes comprise an open end and a closed end, wherein the at least one front panel comprises at least one front shoulder edge that extends from a collar opening of the garment to a front portion of the open end of the first U-shaped armhole or the second U-shaped armhole, and wherein the at least one back panel comprises at least one back shoulder edge that extends from the collar opening of the garment to a back portion of the open end of the first U-shaped armhole or the second U-shaped armhole;

extending the vest component over the shrug component;

extending the first sleeve of the shrug component through the first U-shaped armhole of the vest component;

extending the second sleeve of the shrug component through the second U-shaped armhole of the vest component;

affixing the at least one front shoulder edge of the at least one front panel of the vest component to the front shoulder portion of the respective superior sleeve portion of the first sleeve or the second sleeve of the shrug component;

affixing the at least one back shoulder edge of the at least one back panel of the vest component to the back shoulder portion of the respective superior sleeve portion of the first sleeve or the second sleeve of the shrug component; and not affixing the first inferior sleeve portion and the second inferior sleeve portion of the respective first sleeve and the second sleeve of the shrug component to the closed end of each of the first U-shaped armhole and the second U-shaped armhole of the vest component.

12. The method of claim 11 further comprising the steps of:

further affixing the vest component to the shrug component at bottom edges of the at least one front panel and the at least one back panel of the shrug component.

13. The method of claim 12, wherein the bottom edges of the at least one front panel and the at least one back panel of the shrug component are bonded to the vest component.

14. The method of claim 12, wherein the bottom edges of the at least one front panel and the at least one back panel of the shrug component are heat pressed to the vest component.

15. The method of claim 11, wherein the shrug component is further affixed to the vest component at a collar area defining the collar opening of the garment.

16. A garment comprising:

a shrug component comprising at least one shrug back panel, a right sleeve extending from the at least one shrug back panel, and a left sleeve extending from the at least one shrug back panel, wherein each of the right sleeve and the left sleeve comprise a superior sleeve portion and an inferior sleeve portion, wherein the superior sleeve portion of each of the right sleeve and the left sleeve comprises a front shoulder portion and a back shoulder portion; and a sleeveless vest component extending, in part, over the shrug component, the vest component comprising a right vest front panel, a left vest front panel, and at least one vest back panel, wherein:

when the right vest front panel is affixed to the at least one vest back panel at a right side seam, and when the left vest front panel is affixed to the at least one vest back panel at a left side seam, the right vest front panel and the at least one vest back panel form a right U-shaped armhole, and the left vest front panel and the at least one vest back panel form a left U-shaped armhole, each of the right U-shaped armhole and the left U-shaped armhole comprise an open end and a closed end, wherein the open end is located superior to the closed end, the right vest front panel comprises a right shoulder edge that extends from a collar opening of the garment to a front portion of the open end of the right U-shaped armhole, and the left vest front panel comprises a left shoulder edge that extends from the collar opening of the garment to a front portion of the open end of the left U-shaped armhole, and the at least one back panel comprises a back-right shoulder edge that extends from the collar opening of the garment to a back portion of the open end of the right U-shaped armhole, and a left-back shoulder edge that extend from the collar opening of the garment to a back portion of the open end of the left U-shaped armhole, the right sleeve of the shrug component extends through the right U-shaped armhole and the left sleeve of the shrug component extends through the left U-shaped armhole of the vest component, the right shoulder edge of the right vest front panel is affixed to the front shoulder portion of the superior sleeve portion of the right sleeve, the left shoulder edge of the left vest front panel is affixed to the front shoulder portion of the superior sleeve portion of the left sleeve, the back-right shoulder edge of the at least one vest back panel is affixed to the back shoulder portion of the superior sleeve portion of the right sleeve, the back-left shoulder edge of the at least one vest back panel is affixed to the back shoulder portion of the superior sleeve portion of the left sleeve, the inferior sleeve portion of the right sleeve is not affixed to the closed end of the right U-shaped armhole, and the inferior sleeve portion of the left sleeve is not affixed to the closed end of the left U-shaped armhole.

17. The garment of claim 16, wherein a bottom margin of the at least one shrug back panel of the shrug component extends a first distance from a collar of the garment, and a bottom margin of the at least one vest back panel of the vest component extends a second distance from the collar of the garment.

18. The garment of claim 17, wherein the first distance is different from the second distance.

19. The garment of claim 17, wherein the second distance is greater than the first distance.

20. The garment of claim 17, wherein the bottom margin of the at least one shrug back panel of the shrug component is affixed to the at least one vest back panel of the vest component.

* * * * *